US008830132B1

(12) United States Patent
Doane et al.

(10) Patent No.: US 8,830,132 B1
(45) Date of Patent: Sep. 9, 2014

(54) PARASITIC ANTENNA ARRAY DESIGN FOR MICROWAVE FREQUENCIES

(75) Inventors: Jonathan P. Doane, Cedar Rapids, IA (US); Bryan S. McCoy, Cedar Rapids, IA (US); David W. Cripe, Mount Vernon, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 507 days.

(21) Appl. No.: 12/729,372

(22) Filed: Mar. 23, 2010

(51) Int. Cl.
*H01Q 9/00* (2006.01)

(52) U.S. Cl.
USPC ..... 343/751; 343/833

(58) Field of Classification Search
USPC ..... 343/751, 833, 834
See application file for complete search history.

(56) References Cited

U.S. PATENT DOCUMENTS 3,560,978 A 2/1971 Himmel et al.
4,700,197 A 10/1987 Milne
5,767,807 A * 6/1998 Pritchett ..... 342/374
6,407,719 B1 * 6/2002 Ohira et al. ..... 343/893
6,515,635 B2 2/2003 Chiang et al.
6,677,898 B2 1/2004 Cheng et al.
6,987,493 B2 1/2006 Chen
8,525,748 B2 * 9/2013 Noguchi et al. ..... 343/833

OTHER PUBLICATIONS

Harrington, Roger F, "Reactively Controlled Directive Arrays"; IEEE Transactions on Antennas and Propagation, May 1978, pp. 390-395, vol. AP-26, No. 3, IEEE.

* cited by examiner

*Primary Examiner* — Hoang V Nguyen
(74) *Attorney, Agent, or Firm* — Donna P. Suchy; Daniel M. Barbieri

(57) ABSTRACT

The present invention is load circuit for a parasitic antenna element of a parasitic antenna array. The load circuit may include a DC bias current source, a resistor connected to the DC bias current source, one or more capacitors connected to the resistor, and multiple (ex. —two) diodes connected to the parasitic antenna element. The first diode may be configured for directly connecting the parasitic element to a ground plane of the parasitic antenna array. The second diode may be configured for connecting the parasitic element to the ground plane via the one or more capacitors. The load circuit may be configured for providing a variable (ex. —adjustable) impedance to the parasitic antenna array.

11 Claims, 4 Drawing Sheets

PARASITIC ANTENNA ARRAY DESIGN FOR MICROWAVE FREQUENCIES

FIELD OF THE INVENTION

The present invention relates to the field of antenna technology and particularly to an improved parasitic antenna array design for microwave frequencies.

BACKGROUND OF THE INVENTION

Currently available parasitic antenna arrays may implement variable reactance via a single component, such as a PIN diode, a varactor diode, or a variable capacitor. Further, with said currently available parasitic antenna array implementations, a standard DC bias network may be attached which uses a large resistance or inductance for an RF choke. In these currently available implementations, the effects of the interconnect impedance (such as via inductance) are neglected. Such effects may become increasingly significant at higher frequencies, especially if tuned structures, such as quarter wavelength lines, are used. Thus, these currently available implementations fail to produce the requisite impedances for proper high efficiency operation of a parasitic array at higher microwave frequencies (ex. —frequencies greater than 3 Gigahertz (GHz)).

Thus, it would be desirable to provide a parasitic antenna array implementation which obviates the problems associated with currently available implementations.

SUMMARY OF THE INVENTION

Accordingly, an embodiment of the present invention is directed to a parasitic antenna array, including: a substrate, the substrate including a first surface and a second surface, the second surface being disposed generally opposite the first surface; a monopole element, the monopole element being connected to the substrate, the monopole element configured for radiating electromagnetic energy in an omni-directional radiation pattern; a ground plane, the ground plane being directly connected to the second surface of the substrate; a plurality of parasitic elements, the plurality of parasitic elements being connected to the substrate; and a plurality of load circuits, the plurality of load circuits being connected to the plurality of parasitic elements, the plurality of load circuits further being directly connected to the ground plane.

An additional embodiment of the present invention is directed to a load circuit for a parasitic element of a parasitic antenna array, the load circuit including: a DC bias current source; a resistor, the resistor configured for being connected to the DC bias current source; at least one capacitor, the at least one capacitor configured for being connected to the resistor; and a plurality of diodes, the plurality of diodes configured for being connected to the parasitic element of the parasitic antenna array, a first diode included in the plurality of diodes being configured for directly connecting the parasitic element to a ground plane of the parasitic antenna array, a second diode included in the plurality of diodes being configured for connecting the parasitic element to the ground plane via the at least one capacitor, wherein the load circuit is configured for providing an impedance to the parasitic element.

A further embodiment of the present invention is directed to a method of operation of a parasitic antenna array, the method including: transmitting a first current from a DC bias current source of a load circuit of the parasitic antenna array to a resistor of the load circuit; providing a second current from the resistor to a capacitor of the load circuit, the second current being based upon the first current; transmitting a third current from the capacitor to a plurality of diodes of the load circuit, the third current being based upon the second current, the third current including a DC bias current; providing an impedance from the plurality of diodes of the load circuit to a parasitic element of the parasitic antenna array, the impedance being based upon the DC bias current; receiving an RF feed via an RF feed line; in response to receiving said RF feed, radiating electromagnetic energy in an omni-directional radiation pattern via a monopole element of the parasitic antenna array; and one of: reflecting the radiated electromagnetic energy via the parasitic element; or directing the radiated electromagnetic energy through the parasitic element.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
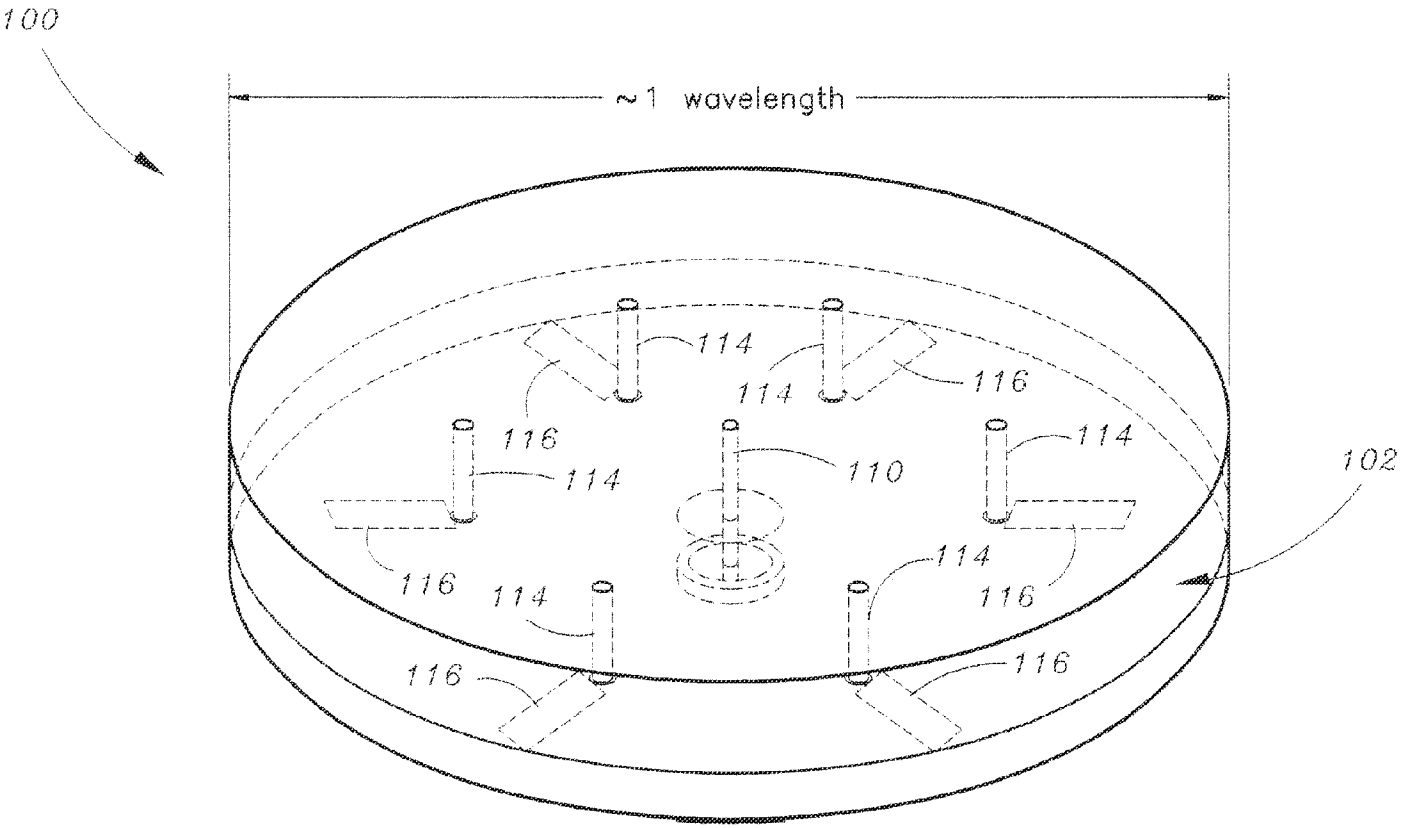
FIG. 1 is a view of a parasitic antenna array in accordance with an exemplary embodiment of the present invention.
Figure 2A:
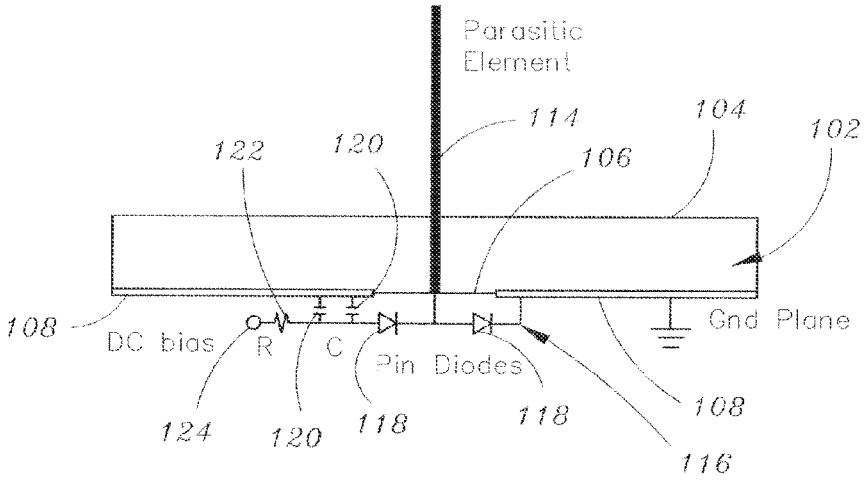
FIG. 2A is a view of a load circuit connected to the substrate of the parasitic array shown in FIG. 1 in accordance with an exemplary embodiment of the present invention.

Referring to FIG. 1, an antenna array (ex. —an antenna) in accordance with an exemplary embodiment of the present invention is shown. In a current exemplary embodiment of the present invention, the antenna array 100 may be a parasitic antenna array (ex. —a parasitic antenna) 100. In further embodiments of the present invention, the parasitic antenna array 100 may include a substrate 102. In exemplary embodiments of the present invention, the substrate 102 may be at least partially formed of printed circuit board material. Further, the substrate 102 may include a first surface (ex. —a top surface) 104 and a second surface (ex. —a bottom surface) 106 disposed generally opposite the first surface 104. Still further, a ground plane 108 may be connected to (ex. —may be configured on) the bottom surface 106 (as shown in FIG. 2A). In further embodiments of the present invention, the length of the antenna substrate 102 may be approximately one wavelength.

In further embodiments of the present invention, the parasitic antenna array 100 may further include a central element 110 connected to the substrate 102. For instance, the central element 110 may be a monopole element (ex. —a central monopole element) 110. Further, the central element 110 may be connected to the substrate 102 and the ground plane 108 at a generally central location of the substrate 102 and the ground plane 108 (as shown in FIG. 1). Still further, the central element 110 may be an omni-directional element 110 configured for radiating electromagnetic energy in an omni-directional radiation pattern (ex. —in a monopole-like pattern). In further embodiments of the present invention, the central element 110 may be configured for being connected to a feed line (exs. —a Radio Frequency (RF) feed line, coaxial cable) 112.

In exemplary embodiments of the present invention, the parasitic antenna array 100 may further include a plurality of parasitic elements (ex. —parasitic pins) 114. In the illustrated embodiment, the parasitic antenna array 100 includes six parasitic elements 114. However, varying numbers of parasitic elements 114 may be implemented in the parasitic antenna array 100 of the present invention. In further embodiments, the parasitic elements 114 may be connected to the substrate 102 and may be configured (exs. —oriented, arranged, located, established) in a generally circular arrangement so as to at least substantially surround (exs. —form a ring-like arrangement around, encircle) the central monopole element 110, wherein said central monopole element 110 may be generally centrally located within (ex. —may form the hub of) the ring created by the plurality of parasitic elements 114. In the illustrated embodiment of the present invention, one ring of parasitic elements 114 is established around the central monopole element 110. In alternative embodiments of the present invention, multiple rings of parasitic elements 114 may be configured around the central monopole element 110 for increasing gain of directional beams radiated by the parasitic antenna array 100.

In current exemplary embodiments of the present invention, each parasitic element 114 may be connected to a load (exs. —a load circuit, a variable impedance load) 116. For example, each parasitic element 114 may have a corresponding load circuit 116 connected (ex. —physically and electrically) to a base portion of said parasitic element 114 (as shown in FIG. 2A). In further embodiments, each load circuit 116 may be connected (ex. —physically and electrically) to the ground plane 108 configured on the bottom surface 106 of the substrate 102 (as shown in FIG. 2A). In still further embodiments of the present invention, each load circuit 116 may be an adjustable load circuit (ex. —an adjustable load) 116. Further, each load circuit 116 may be a parasitic load circuit (ex. —a parasitic load) 116.

Referring generally to FIG. 2A, a parasitic element 114 which is connected to its corresponding load circuit 116 is shown. In exemplary embodiments of the present invention, the load circuit 116 may include a plurality of diodes 118. For example, the load circuit 116 may include two diodes 118, such as two p-type, intrinsic, n-type (PIN) diodes 118. In further embodiments of the present invention, the load circuit 116 may further include one or more capacitors 120, the one or more capacitors 120 configured for being connected to at least one of the PIN diodes 118. In still further embodiments of the present invention, the load circuit 116 may further include a resistor 122, the resistor 122 configured for being connected to at least one of the one or more capacitors 120. In further embodiments of the present invention, the load circuit 116 may further include a Direct Current (DC) bias current source 124, the DC bias current source 124 configured for being connected to the resistor 122.

In current exemplary embodiments of the present invention, the two PIN diodes 118 of the load circuit 116 may be configured for being connected to each other. Further, the load circuit's corresponding parasitic element 114 may be configured for being connected between the two PIN diodes 118. Further, one of the two PIN diodes 118 may be configured for directly connecting the parasitic element 114 to the ground plane, while the other of the two PIN diodes 118 may be configured for connecting the parasitic element 114 to the ground plane 108 through one or more low impedance capacitors 120.

In exemplary embodiments of the present invention, the DC bias current source 124 may be configured for providing DC bias current to the resistor 122. The DC bias current may be transmitted through (ex. —may pass through) the resistor, thereby producing a voltage across the resistor 122. In further embodiments, the resistor 122 and capacitor(s) 120 may form a low pass filter for providing the DC bias current to the diodes 118. For example, in at least one embodiment, when electromagnetic energy is radiated by the monopole element 110, it may contact a parasitic element 114 and the electromagnetic energy (ex. —RF energy) may flow from the parasitic element 114 to a diode 118 of the load circuit 116 for that parasitic element and the RF energy may be shorted from the diode 118 directly to the ground plane 108 via the capacitor(s) 120. In still further embodiments, the resistor 122 may be small and/or may be sized to set a desired current level for a desired voltage.

Figure 3:
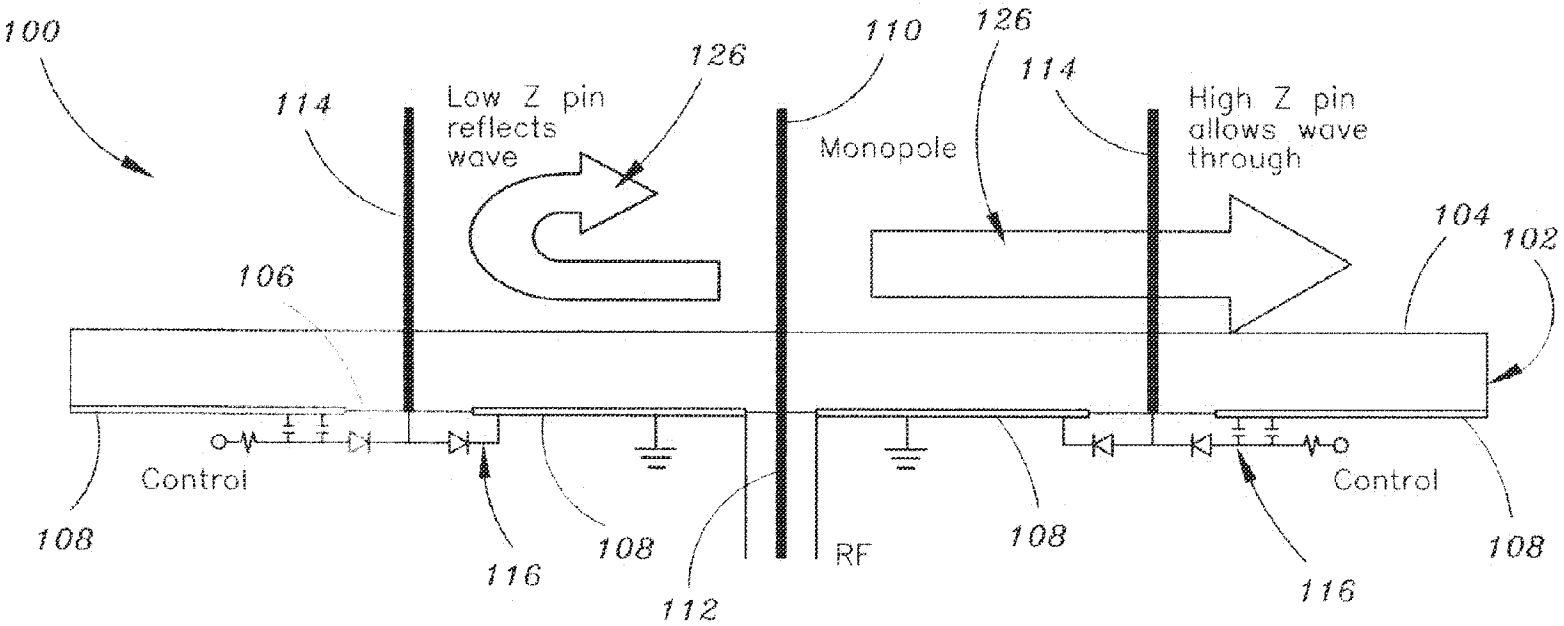
FIG. 3 is a block diagram schematic illustrating the operation of the parasitic antenna array shown in FIG. 1 in accordance with a further exemplary embodiment of the present invention.

In current exemplary embodiments of the present invention, the load circuit (ex. —variable impedance load) 116 may be configurable for allowing a variable (ex. —adjustable) impedance to be applied to the load circuit's corresponding parasitic element 114. As mentioned above, the monopole element 110 may be configured for receiving RF energy via the feed line 112 (as shown in FIG. 3). Further, based upon the received RF energy, the monopole element 110 may be configured for radiating electromagnetic energy (ex. —electromagnetic waves 126) in multiple directions (ex. —towards multiple parasitic elements 114 of the array 100). The electromagnetic waves 126 may excite a voltage (ex. —an applied voltage) on multiple parasitic elements 114. The relationship of the voltage and current present on a particular parasitic element 114 may be determined by the impedance (Z) applied to that parasitic element 114 via its load circuit 116 (ex. —a change in the voltage and current for the parasitic element 114 means that applied impedance provided via the load circuit 116 for that parasitic element 114 is changed also). For instance, when the applied impedance provided to a parasitic element 114 via its corresponding load circuit 116 is low (ex. —low Z), the current on that parasitic element 114 may be high (ex. —may be higher than the current present on the monopole element 110), which may cause the parasitic element 114 to reflect a wave radiated by the monopole 110 (as shown in FIG. 3). Further, when the applied impedance provided to a parasitic element via its corresponding load circuit 116 is high (ex. —high Z), the current on that parasitic element 114 may be low (ex. —may be lower than the current present on the monopole element 110), which may cause the parasitic element 114 to be transparent to a wave radiated by the monopole 110 (ex. —the parasitic element 114 may allow a wave radiated by the monopole 110 to pass through it). Thus, the applied impedance provided to each parasitic element 114 via its corresponding load circuit 116 may be selectively varied for causing the parasitic antenna array 100 to take (ex. —manipulate) the omni-directional monopole field radiated by the monopole element 110 and to radiate either multiple directional beams (ex. —azimuthal directional beams) or an omni-beam (ex. —a monopole-like radiation pattern). The parasitic antenna array 100 of the present invention is configured for applying the variable impedance to the parasitic elements 114 (via the variable impedance loads 116) for causing the antenna array 100 to produce a desired radiation pattern, and, unlike currently available parasitic antenna arrays, the parasitic antenna array 100 of the present invention is configured for doing this efficiently even at high (ex. —15 GHz) frequencies.

Figure 2B:
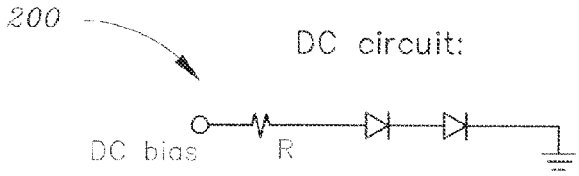
FIG. 2B is a block diagram schematic illustrating the operation of the load circuit shown in FIG. 2A when the parasitic antenna array is operating at low frequencies (ex. —3 GHz) in accordance with a further exemplary embodiment of the present invention.
Figure 2C:
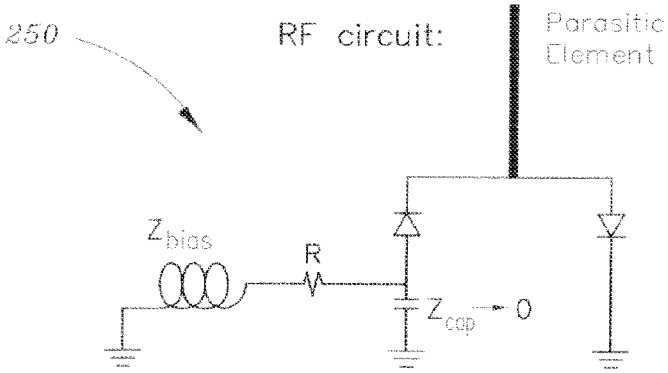
FIG. 2C is a block diagram schematic illustrating the operation of the load circuit shown in FIG. 2A when the parasitic antenna array is operating at high frequencies (ex. —15 GHz) in accordance with a still further exemplary embodiment of the present invention.

In exemplary embodiments of the present invention, it is the diodes 118 of each load circuit 116 which may control the RF load of each parasitic element, thereby affecting mutual coupling and reflectivity of the parasitic antenna array 100. In current exemplary embodiments of the present invention, depending upon the frequencies at which the parasitic antenna array 100 is operating at during a given time, the load circuit 116 may be configured for operating as a DC circuit or an RF circuit. For instance, when the parasitic antenna array 100 is operating at lower frequencies (ex. —3 GHz or below), each load circuit 116 may be configured for operating as a DC circuit 200 (as shown in FIG. 2B) in which the diodes 118 are placed in (ex. —connected in) series, thereby allowing the total DC current draw to be the same as a load circuit which implements only a single diode. As mentioned above, the parasitic antenna array 100 of the present invention is configured for applying the variable impedance to the parasitic elements 114 (via the variable impedance loads 116) for causing the antenna array 100 to produce a desired radiation pattern, and is configured for doing this efficiently even at high (ex. —15 GHz) frequencies. For instance, when the parasitic antenna array 100 is operating at higher frequencies (ex. —15 GHz), each load circuit 116 may be configured for operating as an RF circuit 250 (as shown in FIG. 2C) in which the diodes 118 are in parallel and any undesired impedance from the DC bias current source (ex. —DC bias circuit) 124 is shorted out by the parallel diode 118 tied directly to ground 108, thereby allowing the parasitic antenna array 100 of the present invention to provide dramatically improved performance and efficiency at higher frequencies relative to currently available parasitic antenna arrays 100.

The parasitic antenna array 100 of the present invention may provide improved RF and DC performance over currently available parasitic antenna arrays because the parasitic antenna array 100 of the present invention does not implement a biasing scheme which depends upon inductors (inductors may often be impractical and lossy at high frequencies), nor does the parasitic antenna array 100 of the present invention implement a biasing scheme which depends upon quarter wave matching sections (quarter wave matching sections may often be lossy and band limiting), nor does the parasitic antenna array 100 of the present invention implement a biasing scheme which depends upon large blocking resistors (large blocking resistors may be impractical for current-controlled devices).

Further, the parasitic antenna array 100 of the exemplary embodiments of the present invention may be configured for usage (ex. —practical usage) at higher microwave frequencies, such as up to Ku band (ex. —15 Gigahertz (GHz)). For example, the parasitic antenna array 100 of the present invention may exhibit a directional gain which is greater than 5 dBi (decibels (isotropic)) at 15 GHz. Further, the parasitic antenna array 100 of the exemplary embodiments of the present invention may be configured for being omni-directional, may be suitable for mobile microwave Intelligence Surveillance Reconnaissance (ISR) data links (ex. —ISR applications), and/or may be suitable for Unmanned Aerial Vehicles (UAV) applications, hand-held applications, soldier platforms, Miniature Common Data Link (MiniCDL) applications, and/or Quint Networking Technology (QNT) applications. Still further, the parasitic antenna array 100 of the present invention may represent a significant size, weight, power and cost (SWAP-C) improvement (exs. —smaller SWAP-C, greater than 50 times size, weight and cost reduction) compared to currently available Ku band antennas (ex. —Intelligence Surveillance and Reconnaissance (ISR) Ku band antennas).

Because the parasitic antenna array 100 of the present invention distributes thermal load across two devices (ex. —across two PIN diodes 118), the parasitic antenna array 100 of the present invention may provide improved power handling over currently available parasitic antenna arrays. Further, because the parasitic antenna array 100 of the exemplary embodiments of the present invention may dissipate power across multiple diodes 118, the parasitic antenna array of the present invention may be configured for achieving higher power operation (ex. —greater than 20 Watts (>20 W)) than currently available parasitic antenna arrays.

In further embodiments of the present invention, all interconnects for the parasitic antenna array 100 may be configured for being as short as possible, so as to remove any undesired impedances. Further, because the ground plane 108 of the parasitic antenna array 100 of the present invention is configured on the same side (ex. —the bottom 106) of the substrate 102 as the load circuit 116, this eliminates the need for the parasitic antenna array 100 of the present invention to have inductive vias. This is advantageous as inductive vias often add significant impedance at high frequencies.

In exemplary embodiments of the present invention, large resistances may be placed in parallel with each diode 118 to balance reverse bias voltage across the diodes 118, such as when said diodes 118 are not well-matched. Said balancing of reverse bias voltage across the diodes 118 may be performed without significantly impacting RF performance.

In further alternative embodiments of the present invention, other two-terminal variable impedance devices may be implemented, such as varactor diodes and/or variable capacitors.

Figure 4:
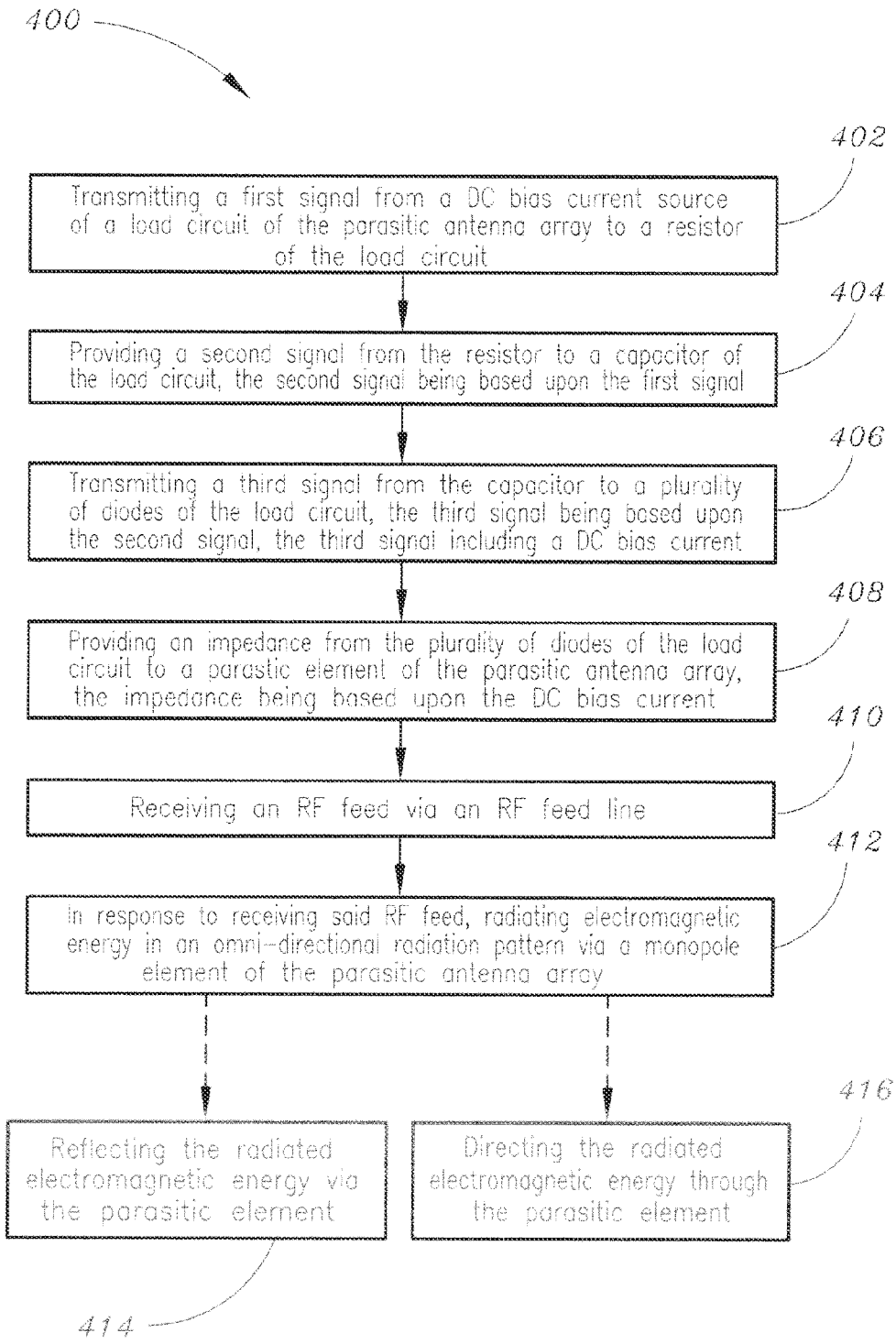
FIG. 4 depicts a flowchart illustrating a method of operation of the parasitic antenna array of the present invention, in accordance with a further exemplary embodiment of the present invention.

Referring generally to FIG. 4, a flowchart illustrating a method of operation of the parasitic antenna array 100 of the present invention in accordance with an exemplary embodiment of the present invention is shown. The method 400 may include the step of transmitting a first current from a DC bias current source of a load circuit of the parasitic antenna array to a resistor of the load circuit 402. The method 400 may further include the step of providing a second current from the resistor to a capacitor of the load circuit, the second current being based upon the first current 404. The method 400 may further include the step of transmitting a third current from the capacitor to a plurality of diodes of the load circuit, the third current being based upon the second current, the third current including a DC bias current 406.

In exemplary embodiments of the present invention, the method 400 may further include the step of providing an impedance from the plurality of diodes of the load circuit to a parasitic element of the parasitic antenna array, the impedance being based upon the DC bias current 408. The method 400 may further include the step of receiving an RF feed via an RF feed line 410. The method 400 may further include the step of, in response to receiving said RF feed, radiating electromagnetic energy in an omni-directional radiation pattern via a monopole element of the parasitic antenna array 412. In further embodiments, the method 400 may further include the step of reflecting the radiated electromagnetic energy via the parasitic element 414 or alternatively, the step of directing the radiated electromagnetic energy through the parasitic element (ex.—the parasitic element is transparent to the radiated electromagnetic energy) 416. In further embodiments, the method 400 may include the step of shorting RF energy from a diode included in the plurality of diodes directly to a ground plane of the parasitic antenna array via the capacitor of the load circuit 418 (not shown).

It is understood that the specific order or hierarchy of steps in the foregoing disclosed methods are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A parasitic antenna array, comprising:

a substrate, the substrate including a first surface and a second surface, the second surface being disposed generally opposite the first surface;

a monopole element, the monopole element being connected to the substrate, the monopole element configured for radiating electromagnetic energy in an omni-directional radiation pattern;

a ground plane, the ground plane being directly connected to and located on and in proximity to the second surface of the substrate;

a plurality of parasitic elements, the plurality of parasitic elements being connected to the substrate and extending from the second surface of the substrate, through the substrate and out of the first surface of the substrate; and a plurality of load circuits, the plurality of load circuits being connected to the plurality of parasitic elements, the plurality of load circuits further being directly connected to the ground plane, the plurality of load circuits and the ground plane being in proximity to the second surface of the substrate, each load circuit of the plurality of load circuits including a first diode connected to a parasitic element of the plurality of parasitic elements to the ground plane and a second diode connected to the parasitic element and a capacitor, the capacitor connected to the ground plane.

2. A parasitic antenna array as claimed in claim 1, further comprising:

a feed line, the feed line being connected to the monopole element, the feed line configured for providing RF energy to the monopole element.

3. A parasitic antenna array as claimed in claim 1, wherein the plurality of parasitic elements at least substantially surrounds the monopole element.

4. A parasitic antenna array as claimed in claim 1, wherein a load circuit included in the plurality of load circuits is connected to a base of a parasitic element included in the plurality of parasitic elements, the load circuit being connected to the base of the parasitic element in proximity with the second surface of the substrate.

5. A parasitic antenna array as claimed in claim 4, wherein the load circuit is configured for providing an impedance to the parasitic element.

6. A parasitic antenna array as claimed in claim 5, wherein the impedance provided by the load circuit to the parasitic element is adjustable.

7. A parasitic antenna array as claimed in claim 6, wherein the parasitic element is selectively configurable, based upon the impedance provided to the parasitic element by the load circuit, for one of: reflecting the electromagnetic energy radiated from the monopole element; and allowing transmission through the parasitic element of the electromagnetic energy radiated from the monopole element.

8. The parasitic antenna array of claim 1, wherein the plurality of parasitic elements are configured for usage up to 15 GigaHertz.

9. A parasitic antenna array, comprising:

a substrate, the substrate including a first surface and a second surface, the second surface being disposed generally opposite the first surface;

a monopole element, the monopole element being connected to the substrate, the monopole element configured for radiating electromagnetic energy in an omni-directional radiation pattern;

a ground plane, the ground plane being directly connected to and in proximity to the second surface of the substrate;

a plurality of parasitic elements, the plurality of parasitic elements being connected to the substrate and extending from the second surface of the substrate, through the substrate and out of the first surface of the substrate; and a plurality of load circuits, the plurality of load circuits being connected to the plurality of parasitic elements, the plurality of load circuits further being directly connected to the ground plane, the plurality of load circuits and the ground plane being in proximity to the second surface of the substrate wherein a load circuit included in the plurality of load circuits is connected to a base of a parasitic element included in the plurality of parasitic elements, the load circuit being connected to the base of the parasitic element in proximity with the second surface of the substrate, each load circuit of the plurality of load circuits including a first diode connected to a parasitic element of the plurality of parasitic elements to the ground plane and a second diode connected to the parasitic element and a capacitor, the capacitor connected to the ground plane.

10. A parasitic antenna array, comprising:

a substrate, the substrate including a first surface and a second surface, the second surface being disposed generally opposite the first surface;

a monopole element, the monopole element being connected to the substrate, the monopole element configured for radiating electromagnetic energy in an omni-directional radiation pattern;

a ground plane, the ground plane being directly connected to the second surface of the substrate;

a plurality of parasitic elements, the plurality of parasitic elements being connected to the substrate and extending from the second surface of the substrate, through the substrate and out of the first surface of the substrate; and a plurality of load circuits, the plurality of load circuits being connected to the plurality of parasitic elements, the plurality of load circuits further being directly connected to the ground plane, the plurality of load circuits and the ground plane being in proximity to the second surface of the substrate, each load circuit of the plurality of load circuits including a first diode connected to a parasitic element of the plurality of parasitic elements to the ground plane and a second diode connected to the parasitic element and a capacitor, the capacitor connected to the ground plane.

11. The parasitic antenna array of claim 10, wherein the plurality of parasitic elements are configured for usage up to 15 GigaHertz.

* * * * *